US005870838A

United States Patent [19]

Khayat

[11] Patent Number: 5,870,838

[45] Date of Patent: Feb. 16, 1999

[54] RETRACTABLE SPIKE SYSTEM FOR A FOOTWEAR SOLE

[76] Inventor: René E. Khayat, R.R. 4 Station Main, Perth, Ontario, Canada, K7H 3C6

[21] Appl. No.: 905,693

[22] Filed: Aug. 4, 1997

[51] Int. Cl.[6] ..... A43C 15/00

[52] U.S. Cl. ..... 36/61; 36/134

[58] Field of Search ..... 36/61, 62, 59 R, 36/134

[56] References Cited

U.S. PATENT DOCUMENTS

| | | | |
|---|---|---|---|
| 351,415 | 10/1886 | Weller | 36/61 |
| 1,361,078 | 12/1920 | Lynn | 36/61 |
| 1,487,976 | 3/1924 | Rossi et al. | 36/61 |
| 1,607,296 | 11/1926 | Noël | 36/61 |
| 2,920,404 | 1/1960 | Ross | 36/61 |
| 3,343,283 | 9/1967 | Henry et al. | 36/61 |
| 3,793,751 | 2/1974 | Gordos | 36/61 |
| 4,873,774 | 10/1989 | Lafever | 36/61 |
| 5,269,080 | 12/1993 | Davis | 36/61 X |
| 5,337,494 | 8/1994 | Ricker | 36/61 |
| 5,557,865 | 9/1996 | Sjösvärd | 36/61 |

FOREIGN PATENT DOCUMENTS 2089221 7/1996 Canada .

*Primary Examiner*—B. Dayoan
*Attorney, Agent, or Firm*—Robic

[57] ABSTRACT

A retractable spike system for providing traction when desired under the entire surface of a footwear sole and heel. Two or more retractable spike assemblies are inserted into cavities in the sole and heel of the footwear. The spikes on each assembly can be engaged by a cam or wedge pressing on a carrier plate. All the assemblies are connected together by a rigid coil attached to the cams or a shaft to which the wedges are fixed, in such a manner that a single mechanism can simultaneously retract or extend all the spikes on all assemblies.

18 Claims, 7 Drawing Sheets

RETRACTABLE SPIKE SYSTEM FOR A FOOTWEAR SOLE

BACKGROUND OF THE INVENTION a) Field of the Invention

The present invention relates to a retractable spike system devised to provide multiple spikes under the sole of a footwear and thus to make the footwear non-slippery whenever required by the user.

The invention also relates to a footwear incorporating such a retractable spike system.

b) Brief Description of the Prior Art

It is well known to provide spikes under a footwear such as a shoe or a boot to provide gripping and traction, especially under slippery conditions. Spikes, made of metal or otherwise, are efficient to prevent slipping, but become inconvenient on hard surfaces such as streets or floors.

A typical example of footwears that require spikes in certain conditions only are golf shoes. Gripping is necessary on most surfaces of a golf course; however metal spikes are damaging to the greens and a growing number of golf courses are banning them altogether. Therefore, there is a need for golf shoes with spikes that can be retracted into the soles of the shoes whenever required.

It is already known to provide the heel or sole of a footwear with retractable spikes. Reference can be made in this matter to U.S. Pat. Nos. 351,415 (WELLER); 1,361,078 (LYNN); 1,487,976 (ROSSI et al); 1,607,296 (NOEL); 2,920,404 (ROSS) and 3,343,283 (HENRY et al.). Reference can also be made to Canadian patent 2,089,221 granted to the same Applicant on Jul. 9th, 1996.

This Canadian patent 2,089,221 discloses a retractable spikes assembly insertable into a cavity made in the heel or the sole of a footwear.

The assembly comprises a bottom plate extending flush with the bottom surface of the footwear when the assembly is mounted into the cavity. A carrier plate extends parallel to the bottom plate and above it. This carrier plate has at least two integral spaced apart spikes projecting downwardly. The bottom plate is provided with guiding holes through which the lower ends of the spikes extend.

The assembly also comprises a L-shape member having a vertical arm whose lower end is rigidly attached to the carrier plate, and a horizontal arm extending from the upper end of the vertical arm. The horizontal arm has a central hole through which extends a guiding pin projecting from the bottom plate. A compression spring is mounted on the guiding pin between the bottom plate and the horizontal arm of the L-shaped member. This spring pushes the carrier plate upward when no pressure is applied on it, keeping the spikes retracted into the footwear.

The assembly further comprises a cam held pivotably above the carrier plate, having an angular position where it engages the carrier plate and therefore extends the spikes downward from the bottom surface of the footwear. The cam can be actuate from a side of the heel or sole. For example a peg can be operatively connected to the cam and have an end extending flush with the side of the heel or sole, this end having a slot that can be engaged by an edge of a coin.

This prior art assembly has several advantages. First, its mechanism operates properly even if it becomes clogged with mud. Secondly, the spikes are easy for the user to extend or retract at will. Thirdly, the appearance of the shoe is not unduly affected by this assembly, since only the slotted end of the peg is visible from the outside.

As a matter of fact, the only drawbacks of the prior art assembly described above are the limited number of spikes that can be mounted in the footwear, and the limited area of the bottom surface of the sole they can cover. One such assemblies cannot be used to provide spikes distributed on the entire bottom surface of the footwear, providing more efficient traction for the user. Moreover, even if two or more such assembly are mounted in different cavities made in the heel and sole, each assembly needs to be actuated individually, which can be tiresome for the user.

Therefore, there is a need for a system providing retractable spikes distributed on the entire bottom surface of a footwear, and where all of the spikes are actuated by a single means.

OBJECT AND SUMMARY OF THE INVENTION

A first object of the present invention is to provide a retractable spike system insertable into cavities made in a sole of a footwear, the sole including a heel and a front part, wherein the system comprises a multitude of spikes that are located in both the heel and the front part of the sole.

Another object of the present invention is to provide such a retractable spike system where all the spikes are controlled simultaneously by a single mechanism.

In accordance with the invention, the above objects are achieved with a retractable spike system comprising at least two retractable spike assemblies, one of these assemblies being insertable in a first cavity made in the heel, the remaining assemblies being insertable in a corresponding number of cavities made in the front part of the sole.

Each assembly comprises a carrier plate extending parallel to the bottom surface when the assembly is mounted into the corresponding cavity. The carrier plate is translatable in a direction orthogonal to the bottom surface. A plurality of spikes are fixed to the carrier plate and project downwardly from the same. Each assembly also comprises spring means pressing upward on the carrier plate and holding it at a higher position, hereinafter called "disengaged position", wherein the spikes are retracted into the sole. Plate-translating means, when actuated, hold the carrier plate at a lower position hereinafter called "engaged position", wherein the spikes are projecting downwardly beyond the bottom surface of the sole.

Actuation means are connected to the plate-translating means of at least one of the assemblies and are operable from at least one extremity of the sole. Flexible connecting means are also provided. Such connecting means are rigidly attached to the plate translating means of all assemblies, in such a manner that actuation of one of the plate translating means is transmitted to all the other plate translating means.

Operation of the actuation means of such a system permits to control the plate-translating means of all assemblies and therefore to simultaneously extend or retract the spikes of all assemblies.

In accordance with a first preferred embodiment of the invention, each of the plate-translating means comprises a cam rotatable about a rotation axis generally parallel to an axis extending from the heel to the front part of the sole. The cam has a central portion offset the rotation axis and two opposite end portions aligned with the rotation axis. One of these end portions points toward the heel and is hereinafter called "back end, portion", the other being called "front end portion". The end portions act as pivot means. In this particular embodiment of the invention, cam-holding means pivotably hold the cam in operative position above the carrier plate. The carrier plate is then in the engaged position when the central portion of the cam bears onto it, and in the disengaged position when the central portion extends in a plane parallel to the carrier plate.

Also in this embodiment, the actuation means are connected to the back end portion of the cam on the assembly located at the heel of the sole. These actuation means allow to rotate this cam. The connecting means are attached to the front and back end portions of the cams of adjacent assemblies, respectively, and are devised to transmit a rotation of one of the cams to all the others.

In accordance with a second preferred embodiment of the invention, the connecting means comprises a shaft insertable into a longitudinal cavity made in the sole of the footwear. The shaft extends above all the carrier plates in a direction generally parallel to an axis extending from the heel to the front part of the sole, and is translatable according to axis.

In this embodiment, the plate translating means of each spike assembly comprise at least one wedge, each wedge being fixed to the shaft and having an edge extending diagonally from the shaft in a generally downward direction. A slit for each wedge is cut in the carrier plate, each slit being sized and positioned in such a way that a first larger fraction of the associated wedge extends through the slit when the plate is in the disengaged position, and a second smaller fraction of the associated wedge extends through the slit when the plate is in the engaged position with the diagonal edge of said wedge pushing on the carrier plate. In this manner, translating the shaft allows to simultaneously control the fraction of all the wedges extending through the corresponding slits, thereby controlling the vertical position of all the carrier plates.

The retractable spike system according to the present invention is well suited for providing retractable spikes under the bottom surface of golf shoes, as it meets the following criteria.

First of all, the assemblies of the retractable spike system according to the invention can be made thin enough to fit into a golf shoe sole of typical thickness (about 14 mm), while allowing for the length of the spikes from the bottom surface of the sole when in the extended position to be as long as 6 mm and thus sufficient to provide the necessary traction. Also, the spikes can be installed in a sufficient number and can be easily positioned wherever desired by the manufacturer. Such as, for example, 4 in the heel and 5 in the front portion of the sole. As already mentioned, all of the spikes are controlled by a single mechanism; this mechanism is consistent, dependable and easy to operate. The connecting means are flexible and do not make the shoe uncomfortable for the user. The retractable spike system is resistant to mud or water, and the waterproofness of the shoe itself is not affected by the introduction of the system in the sole. Finally, the retractable spike system according to the present invention can be manufactured easily and at low cost.

The present invention and its advantages will be better understood upon reading the following non-restrictive description of two preferred embodiments thereof, made with reference to the accompanying drawings.

DESCRIPTION OF TWO PREFERRED EMBODIMENTS OF THE INVENTION

Figure 1:
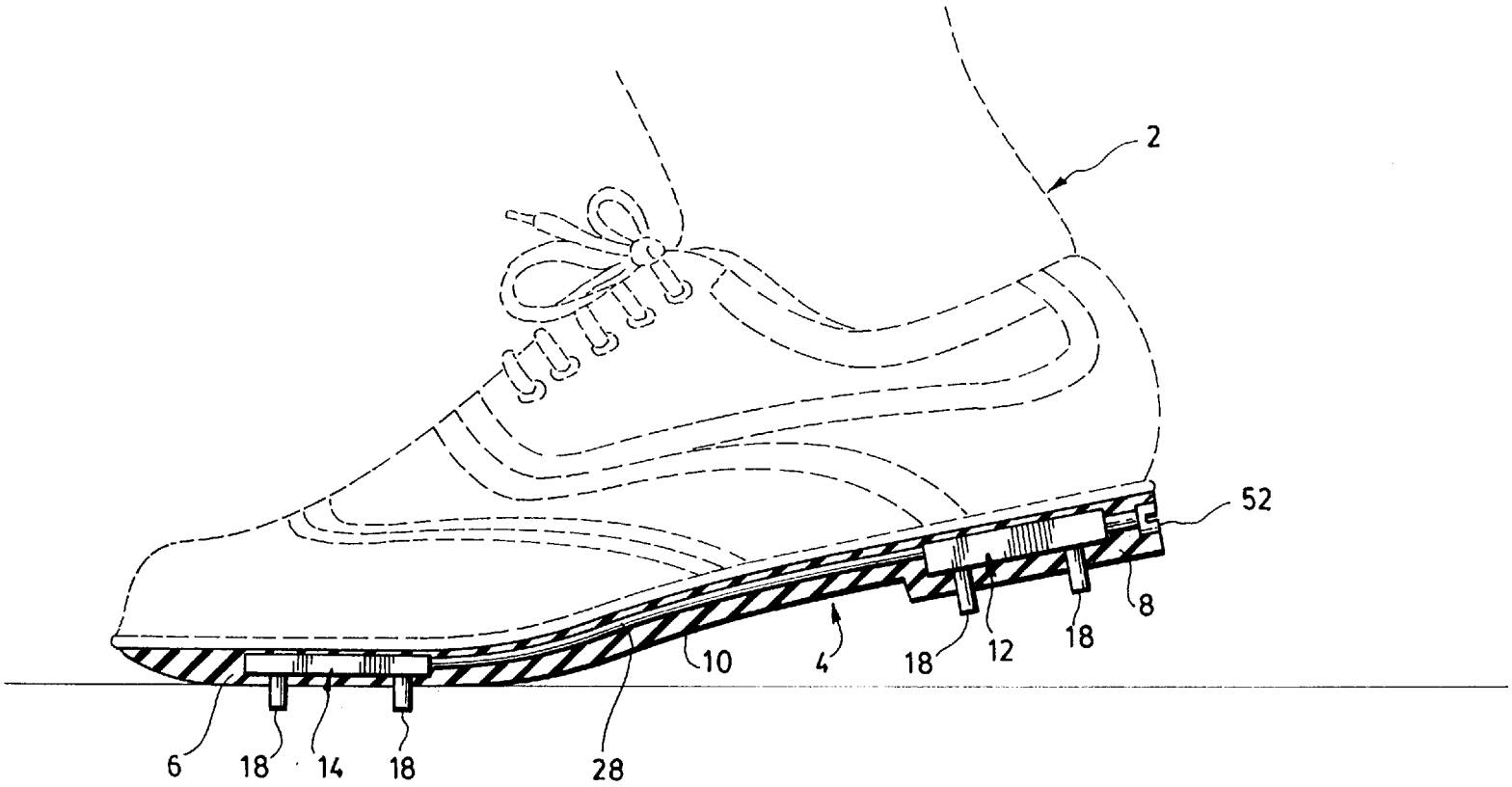
FIG. 1 is a side view of a shoe having its sole shown in a cross section and provided with a retractable spike system according to a first embodiment of the present invention.

FIGS. 1 to 5 illustrate a retractable spike system according to the first preferred embodiment of to the invention. The retractable spike system is intended to be inserted into cavities made in the sole 4 of a footwear 2, the sole 4 including a front part 6 and a heel 8 and having a bottom surface 10.

The system comprise two retractable spike assemblies 12 and 14, the first one of these assemblies numbered 12 being inserted in a first cavity made in the heel 8, the second assembly 14 being inserted in a second cavity made in the front part 6 of the sole 4.

Figure 3:
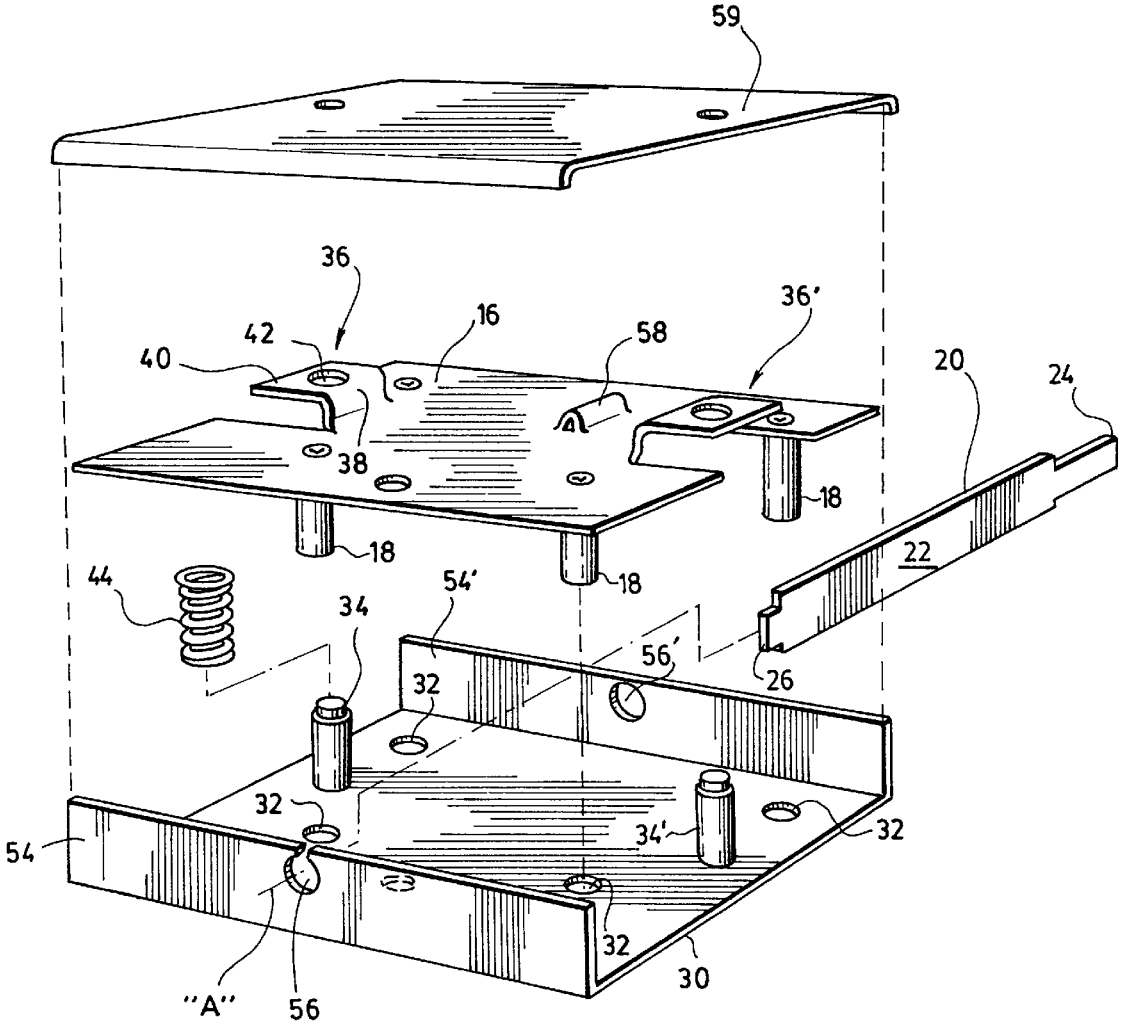
FIG. 3 is an exploded perspective view of one of the retractable spike assemblies of the retractable spike system according to the first embodiment of the invention.
Figure 4:
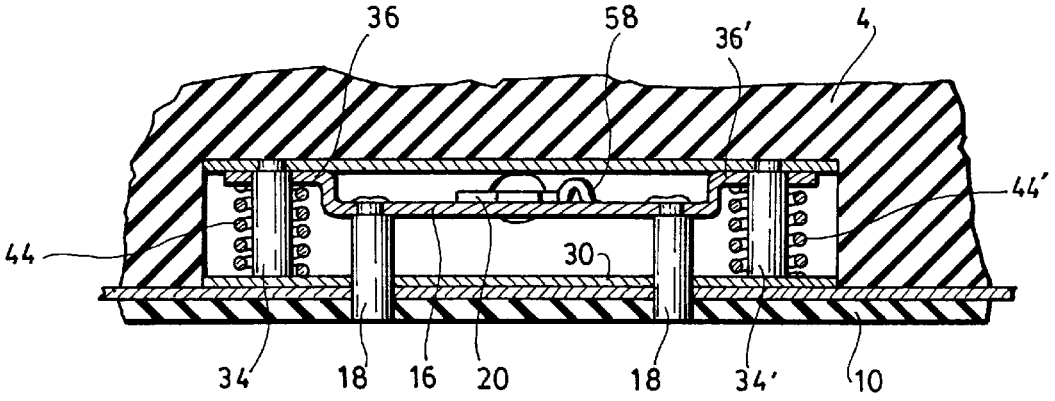
FIG. 4 is a side elevational, cross-section view of the retractable spike assembly of FIG. 3 installed in a shoe sole, showing the spikes in retracted position.
Figure 5:
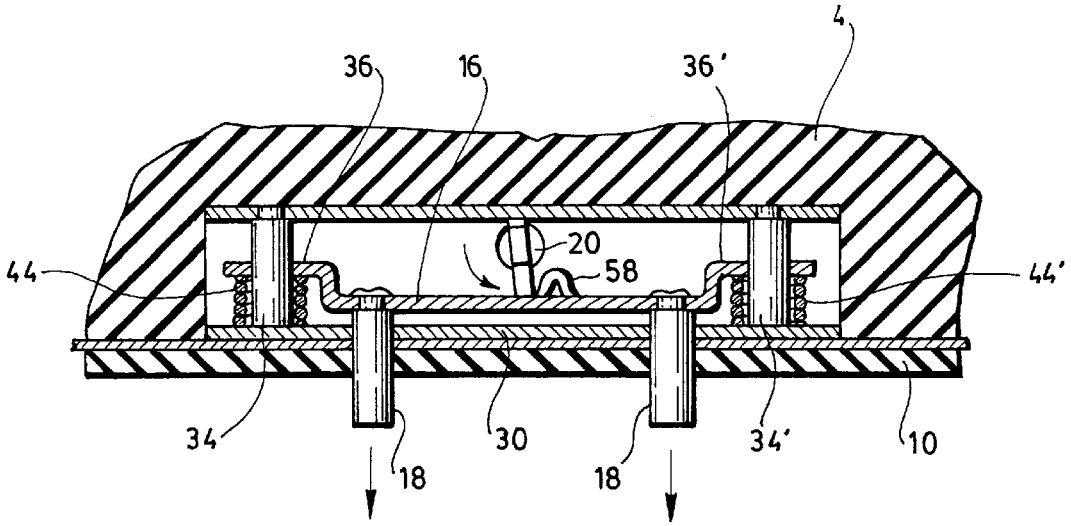
FIG. 5 is a view similar to the one in FIG. 4, showing the spikes in downwardly projecting position.
Figure 6:
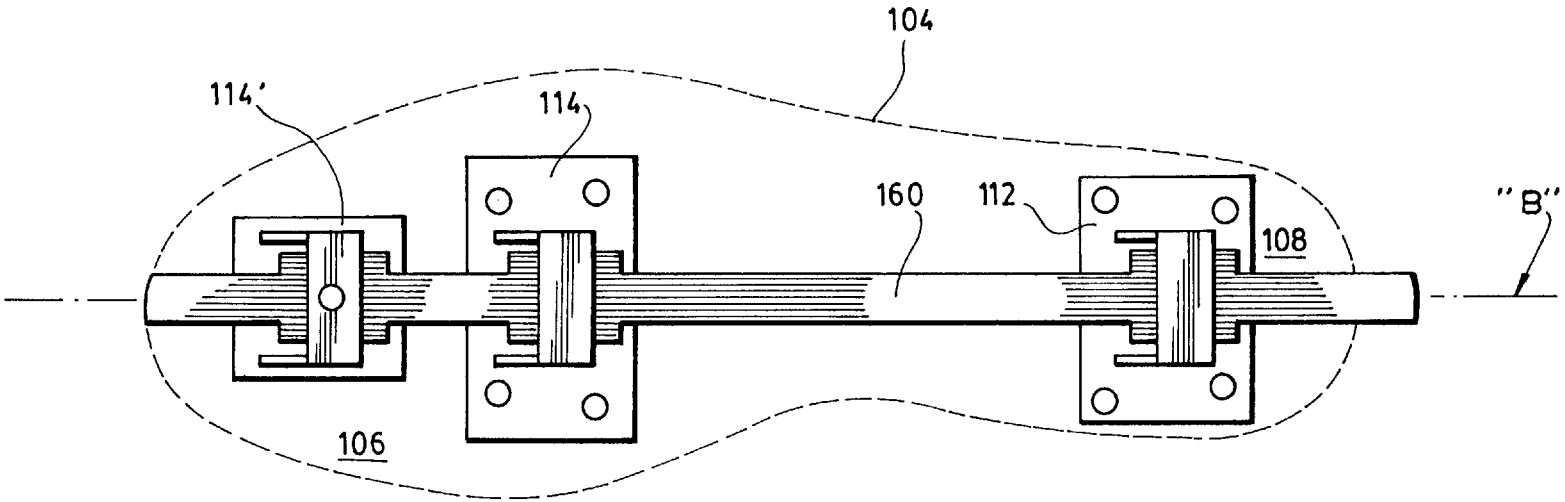
FIG. 6 is a to plan view of the sole of a shoe provided with a retractable spike system according to a second embodiment of the present invention therein.
Figure 7:
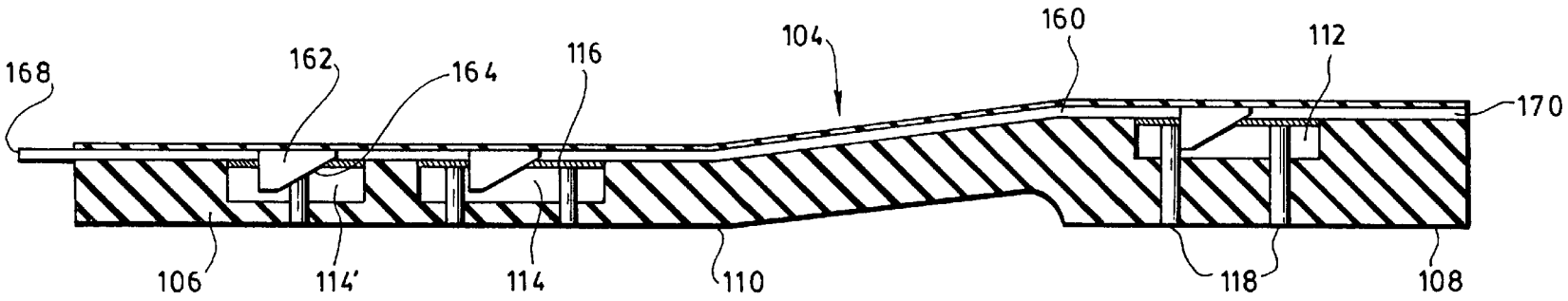
FIG. 7 is a side elevational, cross-section view of the sole and retractable spike system of FIG. 6, showing the spikes in retracted position.
Figure 8:
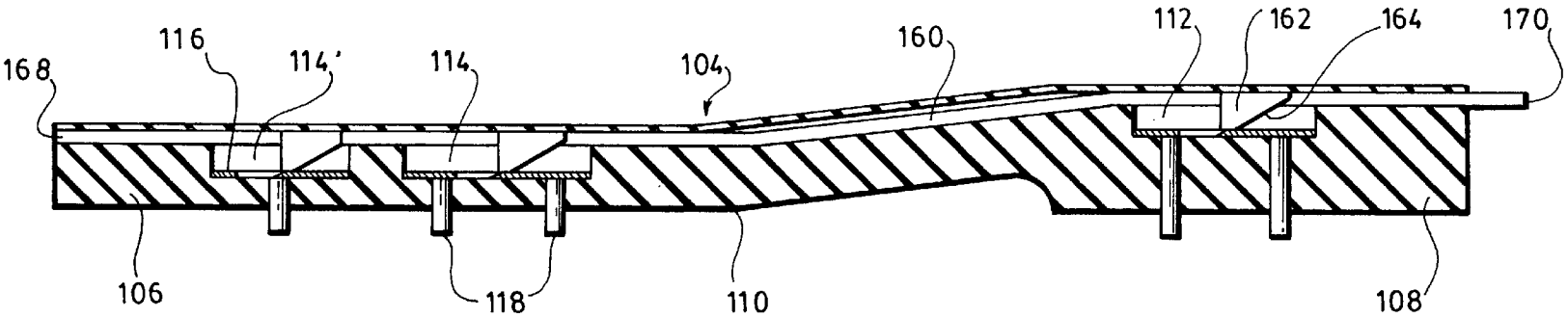
FIG. 8 is a view similar to the one in FIG. 7, showing the spikes in downwardly projecting position.
Figure 9:
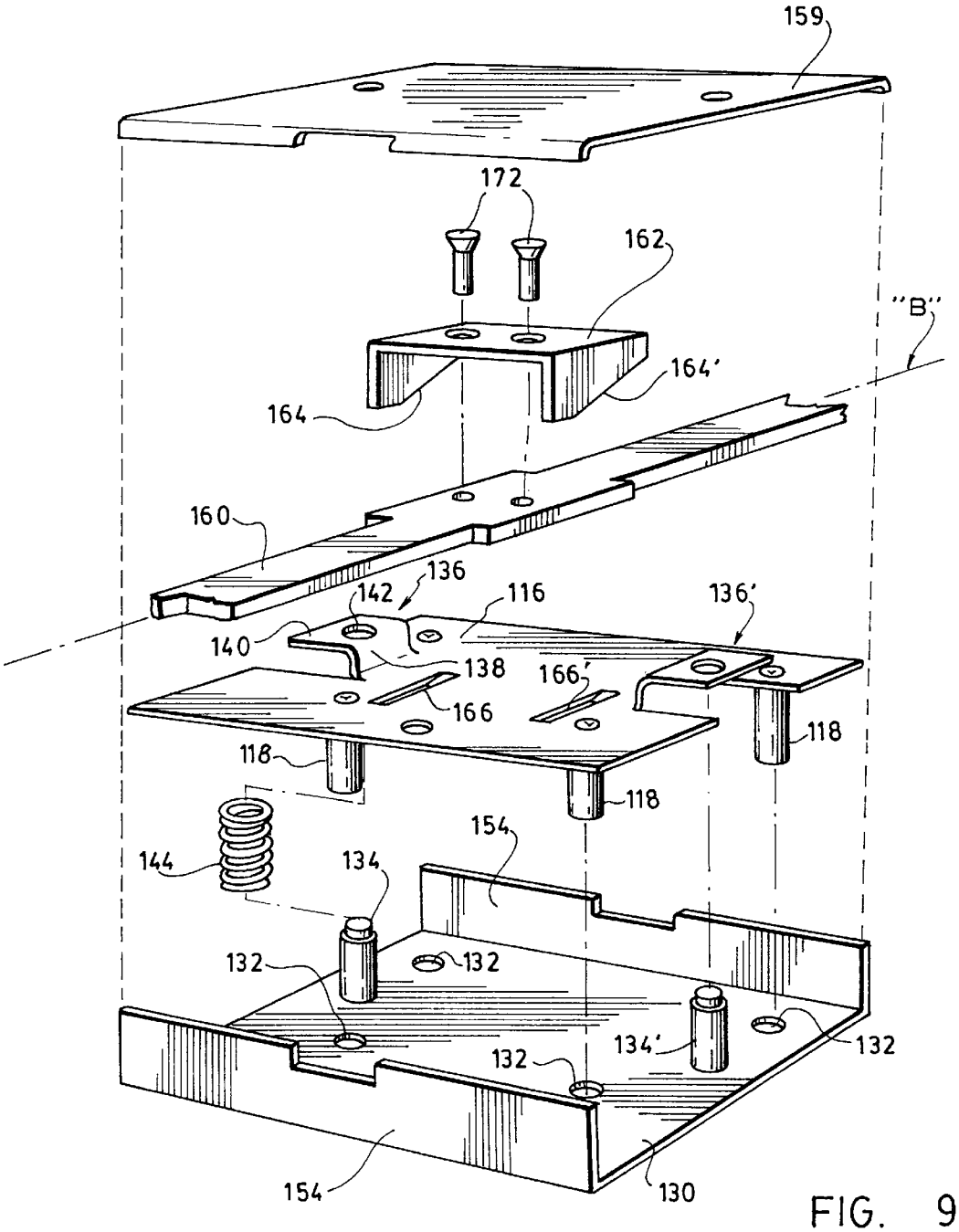
FIG. 9 is an exploded perspective view of one of the retractable spike assemblies of the retractable spike system according to the second embodiment of the invention.

The basic structure and operation of each of the assemblies 12 and 14 are illustrated in FIGS. 3 to 5. Each assembly comprises a carrier plate 16 extending parallel to the bottom surface 10 of the sole when the assembly is mounted into the corresponding cavity. The carrier plate 16 is translatable in a direction orthogonal to the bottom surface 10 as will be better explained hereinafter. A plurality of spikes 18 are fixed to the carrier plate 16 and project downwardly from the same.

Each of the assemblies 12 and 14 also comprises a bottom plate 30 that extends flush with the bottom surface 10 of the sole 4 when the assembly is mounted in the corresponding cavity. The bottom plate 30 comprises a plurality of holes 32 through which the spikes 18 extend when the carrier plate 16 is pushed downward as will be explained hereinafter. Two guide pins 34,34' are rigidly connected to the bottom plate 30 and project upwardly from the same. The pins 34,34' are symmetrically positioned on each side of the bottom plate 30.

Each assembly further comprises two L-shaped members 36,36' each having a first, vertically upstanding arm 38 and a second perpendicular arm 40 extending parallel to the carrier plate 16. The first arm 38 has one end rigidly attached to the carrier plate 16 and another end integrally extended by the second arm 40. The second arm 40 comprises a central hole 42 sized to receive one of the guide pins 34. Each of the L-shaped members 36 are sized and positioned in such a manner that the corresponding guide pin 34 extends through the central hole 42 of the second arm 40.

Each assembly also comprises two compression springs 44,44' mounted on the guide pins 34,34' between the bottom plate 30 and the carrier plate 16. The compression springs 44,44' act as a spring means. They press upward on the carrier plate 16 and hold it at a higher position, hereinafter called "disengaged position", which is shown on FIG. 4, and in which the spikes 18 are retracted into the sole 4.

Plate-translating means are provided to press down on the carrier plate 16 and hold it at a lower position hereinafter called "engaged position" whenever desired. In such a position, the spikes 18 project downwardly beyond the bottom surface 10 of the sole 4, as is show on FIG. 5.

In the illustrated embodiment, each of the plate-translating means comprises a cam 20 rotatable about a rotation axis A generally parallel to an axis extending from the heel 8 to the front part 6 of the sole 4. The cam 20 has a central portion 22 offset the rotation axis and two opposite end portions, namely a back end portion 24 and a front end portion 26 that, aligned with the rotation axis A. The end portions 24 and 26 act as pivot means.

In this particular embodiment of the invention, cam-holding means pivotably hold the cam 20 in operative position above the carrier plate 16. The cam-holding means preferably consists of two opposite wings 54,54' integral to the bottom plate 30 and extending vertically on the front and back side of this bottom plate 30. Holes 56,56' are made in the wings 54,54' to receive the end portions 24 and 26 of the cam 20. The carrier plate 16 is in the engaged position when the central portion 22 of the cam 20 bears onto it, and in the disengaged position when the central portion 22 extends in a plane parallel to the carrier plate 16. Advantageously, a bulge 58 on the carrier plate 16 blocks the rotation of the cam 20 in one direction, allowing the central portion 22 to stay in position when its edge bears on the carrier plate 16 and holds it in the engaged position.

In accordance with a very important aspect of this first preferred embodiment, the system comprises flexible connecting means which are rigidly attached to the back end portion 24 of the cam 20 of the assembly 14, and to the front end portion 26 of the assembly 12. These connecting means are devised to transmit rotation of one of the cams to the other. Advantageously, they consist of a semi-rigid coil 28 as can be seen on FIG. 2, thereby allowing the sole to flex as is common in use (see FIG. 1).

Actuation means are connected to the back end portion 24 of the cam 20 of the assembly 12 and are operable from the heel extremity of the sole 4. They preferably comprise a cylindrical peg 46 insertable into a cylindrical through hole made in a back wall of the heel 8, and aligned with the rotation axis of the cams 20. The peg 46 has an inner end 48, operatively connected to the back end portion 24 of the cam 20 on the assembly 12, and an outer end 50 extending flush with the back wall.

Figures 2, 2A:
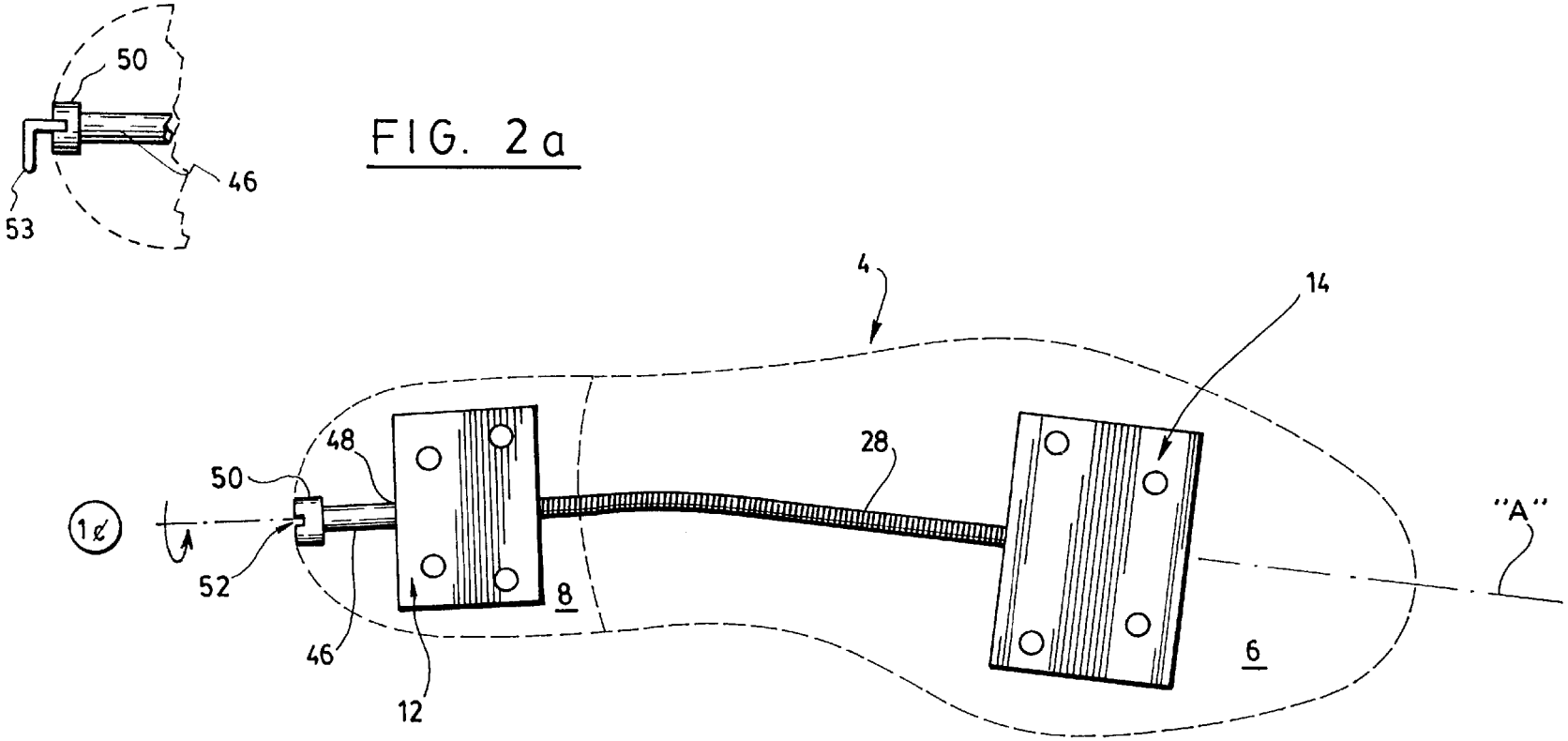
FIG. 2 is a bottom plan view of the sole of the shoe shown in FIG. 1 showing the assemblies.
FIG. 2*a* is a bottom view of the sole of FIG. 2, illustrating a variant of the activation means of the system according to the invention.

Means are provided to allow the wearer of the shoes to rotate the peg 46 and the cam 20 connected thereto. These means can be a diametrically extending slot 52 made in the outer end 50 of the peg 46, the slot being sized to be engaged by and grip the edge of a coin. The coin can thus be used as a tool to operate the actuation means. As shown in FIG. 2*a*, instead of a coin-engageable slot 52, use can be made of a small radial handle 53 fixed to the outer end 50 of the peg 46.

Preferably, a cover plate 59 extends over the carrier plate 16 and is fixed to the upper end of guiding pins 34,34'.

It can be understood that the number of assemblies can be higher than 2. In such a case, correcting means must be provided between each pair of assemblies. It can also be understood that each assembly has been shown with four spikes 18, eventhough the number and positioning of such spikes on the corresponding carrier plate may substantially vary depending on the intended use of the footwear.

FIGS. 6 to 9 illustrate a retractable spike system according to a second preferred embodiment of the invention.

In these FIGS. 6 to 9, any structural elements already present in the first embodiment illustrated in FIGS. 1 to 5 have been identified with the same reference number with a "100", distinguishing addition.

In this second preferred embodiment of the invention, the connecting means comprises a shaft 160 insertable into a longitudinal cavity made in the sole 104 of the footwear. The shaft 160 is made of a flat strip of a rigid yet flexible material such as plastics thereby allowing the sole to flex. It extends above all the carrier plates 116 in a direction generally parallel to an axis B extending from the heel 108 to the front part 106 of the sole 104, and is translatable along this axis.

As is shown, the system comprises three spike assemblies. The third assembly 114' is located in the front part 106 of the sole 104.

The plate translating means of each spike assembly 112, 114,114' comprise a wedge 162 fixed to the shaft 160 by fasteners 172. The wedge 162 has two edges 164,164' extending diagonally from said shaft 160 in a generally downward direction. As better shown on FIG. 9, a slit 166,166' is cut for each edge 164,164' in the carrier plate 116. Each slit 166,166' is sized and positioned in such a way that a first larger fraction of the associated edge 164,164' extends through the slit 166,166' when the carrier plate 116 is in the disengaged position, as seen on FIG. 7, and that a second smaller fraction of the associated edge 164,164' extends through the slit 166,166' and pushes down the carrier plate 116 when this plate 116 is in the engaged position shown on FIG. 8. In this manner, translation of the shaft 160 in the direction of the axis B allows to simultaneously control the fraction of all the edges 164,164' extending through the corresponding slits 166,166', thereby controlling the vertical position of all the carrier plates 116.

In this second preferred embodiment, the length of the shaft 160 is greater than the length of the sole 104. In this manner, one of the ends 168,170 of the shaft 160 necessarily projects away at the front or rear extremity of the sole 4 and acts as an actuation means. Indeed, any pressure exerted on the projecting end 168 or 170 easily achieved by kicking a shoe on a hard surface or material permits to shift the shaft 160 and to move the carrier plates 116 up and down between its engaged and disengaged positions.

Once again, the number of assemblies can be different from 3. It can be 2 or 4 and more. Similarly, the number and positions of the spikes 118 can vary. It may also be understood that the wedges 162 need not be made as is disclosed hereinabove, with two edges. As a matter of fact, such wedges could have one edge only, or more than 2.

As can be appreciated, the retractable spike system according to the invention whatever be the selected embodiment is particularly well adapted for use in the soles of golf shoes. Indeed, its assemblies may be as thin as 10 mm and still allow spikes to project downwardly outwardly from the bottom of the sole at a distance of up to 6 mm. The number and position of the spikes can be adapted to the wearer's requirement. Moreover, all of these spikes are controlled by a single actuation mechanism, which is easy to operate and reliable.

Of course, numerous modifications could be made to the preferred embodiments disclosed hereinabove without departing from the scope of the invention as defined in the appended claims.

I claim:

1. A retractable spike system, insertable into cavities made in a sole of a footwear, the sole including a front part and a heel and having a bottom surface, said system comprising:

at least two retractable spike assemblies, one of said assemblies being insertable in a first cavity made in the heel, the remaining assemblies being insertable a corresponding number of cavities made in the front part of the sole, each assembly comprising a carrier plate extending parallel to the bottom surface when the said assembly in mounted into the corresponding cavity, the carrier plate being translatable in a direction orthogonal to said bottom surface, a plurality of spikes fixed to the carrier plate and projecting downwardly from the same, spring means pressing upward on the carrier plate and holding it at a higher position hereinafter called "disengaged position" wherein the spikes are retracted into the sole, and plate-translating means which, when actuated, holds the carrier plate at a lower position hereinafter called "engaged position" wherein the spikes are projecting downwardly beyond the bottom surface of the sole;

actuation means connected to the plate-translating means of at least one of the assemblies and operable from at least one extremity of the sole; and flexible connecting means rigidly attached to the plate translating means of all assemblies in such a manner that an actuation of one of the plate translating means is transmitted to all the other plate translating means;

whereby by operating the actuation means, one may control the plate-translating means of all assemblies and therefore simultaneously extend or retract the spikes of all assemblies, and wherein:

each of said plate-translating means comprise a cam rotatable about a rotation axis generally parallel to an axis extending from the heel to the front part of the sole, said cam having a central portion offset the rotation axis and two opposite end portions aligned with said rotation axis, one of said end portions pointing toward the heel and being hereinafter called "back end portion", the other of said end portion being called "front end portion", said end portions acting as pivot means, and cam-holding means for pivotably holding the cam in operative position above the carrier plate, said carrier plate being in the engaged position when the central portion of the cam bears onto it and in the disengaged position when the central portion extends in a plane parallel to the carrier plate;

the actuation means are connected to the back end portion of the cam on the assembly located at the heel of the sole, said actuation means allowing to rotate said cam, and the connecting means are attached to the front and back end portions of the cams of adjacent assemblies, respectively, and are devised to transmit a rotation of one of the cams to all the others.

2. The retractable spike system of claim 1, wherein said connecting means consist of a semi-rigid coil.

3. The retractable spike system of claim 2, wherein each spike assembly further comprise:

bottom plate extending flush with the bottom surface of the sole when said assembly is mounted in the corresponding cavity, said bottom plate comprising a plurality of holes through which the spikes extend when the carrier plate is in the engaged position;

two guide pins rigidly connected to the bottom plate and projecting upwardly from said bottom plate, said pins being symmetrically positioned offset the rotation axis;

two L-shaped members each having a first, vertically upstanding arm and a second perpendicular arm extending parallel to the carrier plate, said first arm having one end rigidly attached to the carrier plate and another end integrally extended by the second arm, said second arm comprising a central hole sized to receive one of said guide pins, each of said L-shaped members being sized and attached to the carrier plate in such a manner that the corresponding guide pin extends through the central hole of the second arm when the carrier plate is engaged; and two compression springs mounted on said guide pins between the bottom plate and the carrier plate, said guide pins and compression springs acting as said spring means.

4. The retractable spike system of claim 3, wherein the actuating means comprise:

a cylindrical peg insertable into a cylindrical through hole made in a back wall of the heel and aligned with the rotation axis of the cams, said peg having an inner end operatively connected to the back end portion of the cam on the assembly inserted in the heel, and an outer end extending flush with said back wall; and accessing means to allow a user to rotate the peg and the cam connected thereto.

5. The retractable spike system of claim 4, wherein the accessing means comprise a diametrically extending slot in the outer end of the peg, said slot being sized to be engaged by, and to grip an edge of a coin, whereby said coin can be used as a tool to operate the actuation means.

6. The retractable spike system of claim 4, wherein the accessing means comprise a handle radially fixed to the outer end of the peg, whereby said handle can be used as a gripping tool to operate the actuation means.

7. A retractable spike system, insertable into cavities made in a sole of a footwear, the sole including a front part and a heel and having a bottom surface, said system comprising:

at least two retractable spike assemblies, one of said assemblies being insertable in a first cavity made in the heel, the remaining assemblies being insertable a corresponding number of cavities made in the front part of the sole, each assembly comprising a carrier plate extending parallel to the bottom surface when the said assembly is mounted into the corresponding cavity, the carrier plate being translatable in a direction orthogonal to said bottom surface, a plurality of spikes fixed to the carrier plate and projecting downwardly from the same, spring means pressing upward on the carrier plate and holding it at a higher position hereinafter called "disengaged position" wherein the spikes are retracted into the sole, and plate-translating means which, when actuated, holds the carrier plate at a lower position hereinafter called "engaged position" wherein the spikes are projecting downwardly beyond the bottom surface of the sole;

actuation means connected to the plate-translating means of at least one of the assemblies and operable from at least one extremity of the sole; and flexible connecting means rigidly attached to the plate translating means of all assemblies in such a manner that an actuation of one of the plate translating means is transmitted to all the other plate translating means;

whereby by operating the actuation means, one may control the plate-translating means of all assemblies and therefore simultaneously extend or retract the spikes of all assemblies, and wherein:

the connecting means comprise a shaft insertable into a longitudinal cavity made in the sole of the footwear, the shaft extending above all the carrier plates in a direction generally parallel to an axis extending from the heel to the front part of the sole, said shaft being translatable according to said axis;

the plate translating means of each spike assembly comprise at least one wedge, each wedge being fixed to the shaft and having an edge extending diagonally from said shaft in a generally downward direction, a slit for each wedge, cut in the carrier plate, each slit being sized and positioned in such a way that a first larger fraction of the associated wedge extends through said slit when the plate is in the disengaged position, and a second smaller fraction of the associated wedge extends through said slit when the plate is in the engaged position with the diagonal edge of said wedge pushing on the carrier plate, whereby translating the shaft allows to simultaneously control the fractions of all the wedges extending through the corresponding slits, thereby controlling the vertical position of all the carrier plates.

8. The retractable spike system of claim 7 wherein the sole is of a given length and has a front and rear extremity and wherein said shaft has a pair of opposite ends and a length that is greater than the length of the sole, whereby, in use, one of the ends of said shaft necessarily projects away at the front or rear extremity of the sole and may be used as actuation means to translate the shaft and thus control the vertical position of the carrier plate and spikes attached thereto.

9. The retractable spike system of claim 8 wherein each spike assembly further comprise:

a bottom plate extending flush with the bottom surface of the sole when said assembly is mounted in the corresponding cavity, said bottom plate comprising a plurality of holes through which the spikes extend when the carrier plate is in the engaged position;

two guide pins rigidly connected to the bottom plate and projecting upwardly from said bottom plate, said pins being symmetrically positioned offset the shaft;

two L-shaped members each having a first, vertically upstanding arm and a second perpendicular arm extending parallel to the carrier plate, said first arm having one end rigidly attached to the carrier plate and another end integrally extended by the second arm, said second arm comprising a central hole sized to receive one of said guide pins, each of said L-shaped members being sized and attached to the carrier plate in such a manner that the corresponding guide pin extends through the central hole of the second arm when the carrier plate is engaged; and two compression springs mounted on said guide pins between the bottom plate and the carrier plate, said guide pins and compression springs acting as said spring means.

10. A footwear comprising a retractable spike system as claimed in claim 1.

11. A footwear comprising a retractable spike system as claimed in claim 2.

12. A footwear comprising a retractable spike system as claimed in claim 3.

13. A footwear comprising a retractable spike system as claimed in claim 4.

14. A footwear comprising a retractable spike system as claimed in claim 5.

15. A footwear comprising a retractable spike system as claimed in claim 6.

16. A footwear comprising a retractable spike system as claimed in claim 7.

17. A footwear comprising a retractable spike system as claimed in claim 8.

18. A footwear comprising a retractable spike system as claimed in claim 9.

* * * * *